US005946950A

United States Patent [19]

Tsui et al.

[11] Patent Number: 5,946,950

[45] Date of Patent: Sep. 7, 1999

[54] PUMP INCORPORATED IN A TEXTILE PACKAGE DYEING MACHINE

[75] Inventors: William Tak Ming Tsui, Sale-Cheshire, United Kingdom; Graham Frank Clifford, Stanley, N.C.

[73] Assignee: Palmer Investments Limited, Virgin Islands (Br.)

[21] Appl. No.: 08/882,951

[22] Filed: Jun. 26, 1997

[30] Foreign Application Priority Data

Jun. 27, 1996 [GB] United Kingdom ..... 9613551

[51] Int. Cl.[6] ..... D06F 17/02

[52] U.S. Cl. ..... 68/189; 68/198; 68/177; 68/205 R

[58] Field of Search ..... 415/149.3, 152.2, 415/152.1, 153.1, 153.2; 68/177, 205 R, 189, 198

[56] References Cited

U.S. PATENT DOCUMENTS

| | | | |
|---|---|---|---|
| 3,092,990 | 6/1963 | Schyns | 68/189 |
| 3,967,923 | 7/1976 | Ameling | 8/149.1 |
| 4,747,757 | 5/1988 | Haentjens | 417/366 |
| 5,039,320 | 8/1991 | Hoglund | 55/203 |
| 5,351,351 | 10/1994 | Ono | 8/155.1 |

FOREIGN PATENT DOCUMENTS

| | | | |
|---|---|---|---|
| 207810 | 4/1957 | Australia | 415/152.2 |
| 244274 | 12/1965 | Austria | 68/189 |
| 166143 | 7/1920 | Germany | 415/152.2 |
| 1 081 406 | 5/1960 | Germany | 68/189 |
| 24 56 208 | 11/1974 | Germany | 68/189 |
| 891576 | 3/1962 | United Kingdom . | |
| 1323202 | 7/1973 | United Kingdom . | |

OTHER PUBLICATIONS

International Search Report for International Application No. GB 9613551.2; Sep. 30, 1996.

*Primary Examiner*—Jill Warden
*Assistant Examiner*—Paul J. Lee
*Attorney, Agent, or Firm*—Armstrong, Westerman, Hattori, McLeland, & Naughton

[57] ABSTRACT

A pump has a bearing stand (3) in which a pump shaft (1) is mounted to be driven by an electric motor. The shaft (1) mounts an impeller (9) having blades (10) which cause fluid entering through an axial inlet nozzle (11) to flow, by rotation of the impeller in one direction, through a centrifugal exit nozzle (12) formed by a suitably located quarter toroid **(13*a*), and a half toroid (14), formed as sheet metal pressings. When the impeller (9) is rotated in the opposite direction, the centrifugal nozzle (12) acts as an entry nozzle and the axial nozzle (11)** acts as a discharge nozzle. The pump is particularly suitable for treating textile yarns since said one direction of rotation can be used for out-to-in treatment dye liquor flow where relatively high resistance is encountered and said opposite direction of rotation can be used for in-to-out treatment dye liquor flow where resistance is relatively lower.

5 Claims, 3 Drawing Sheets

PUMP INCORPORATED IN A TEXTILE PACKAGE DYEING MACHINE

BACKGROUND OF THE INVENTION

1. Field of the Invention

This invention generally relates to a pump incorporated in a textile package dyeing machine.

2. Description of the Related Art

Yarn for textile manufacturing purposes is commonly wound on perforated tubular cores to form permeable packages through which dye liquor may be circulated for wet processes such as bleaching or dyeing. Both centrifugal pumps and axial flow pumps have been used for circulating dye liquor through textile material in apparatus for dyeing yarn and other textile products. The characteristics of the two types of pumps are dissimilar.

Yarn packages are supported on perforated tubular or fluted spindles on package carriers which may be submersed in dye liquor for treatment. The dyeing process involves the circulation of dye liquor through the yarn, via these supporting spindles, in a machine having provisions for adding dye liquors and chemicals, and of raising the temperature of the dye liquor while periodically reversing the direction of dye liquor flow.

The most level dyeings are obtained by passing the entire volume of dye liquor through the load at least once while increasing the temperature a fixed increment before repeating the sequence in the opposite direction.

Flow of dye liquor from inside the spindle and out through the yarn package around the spindle tends to open up the package and makes penetration of the dye liquor through the package easier. Flow of dye liquor from outside the package and through the package into the spindle tends to compress the package, increasing resistance to dye liquor flow. Therefore, applying the same pressure in both cases does not produce the same rate of bath turnover.

For applications which offer low resistance to flow, axial flow pumps can deliver higher flowrates than centrifugal pumps. Axial flow pumps have been used instead of centrifugal pumps in package dyeing machines, the flow being reversed by reversing the direction of rotation of the axial flow impeller.

Because the axial flow pump performs best against low resistance, system resistance must be reduced to a minimum, as for example by mounting the axial flow impeller vertically inside the machine, directly underneath the package carrier.

However, as conventional direct drive with the electric motor in line with the pump would greatly increase the height of the machine and put the motor directly under the liquor-containing vessel in a location vulnerable to leaks, the motor can be mounted with its axis vertical with the impeller being driven by belts.

Attempts to incorporate an axial flow pump into an external circulating system introduce system resistance and restrict the designer to the alternatives of using double seals and bearings so as properly to support the impeller, or of having to accept a greater than desirable impeller overhang, as well as a sharp change of direction in system pipework if supported only from one end. This sharp change of direction introduces yet more resistance to which the axial flow pump is not suited.

The softer the package, the greater is the difference in density when flow is changed from inside-out to outside-in, and in some circumstances in machines with axial flow pumps, it has been known for outside-in flowrate to fall to zero, and for reversal of dye liquor flow to be discontinued as it served no purpose.

Similarly, in machines for dyeing softly wound packages in open vessels, in which the temperature is raised as closely as possible to the boiling point of water while the direction of flow is periodically reversed, the characteristics of the centrifugal pump favor the maintenance of outside-in flow at the higher temperatures.

The centrifugal pump has been favored in machines dyeing relatively tight packages, or which have external circulating systems offering resistance to dye liquor flow. The axial flow pump has been favored in systems dyeing soft packages, which offer little resistance to flow, so that it follows that in principle the centrifugal pump is better able to deal with the "outside-in" flow condition, and the axial flow characteristics are more suited to the "inside-out" flow condition.

It would not be practical or economical to equip such a machine with two pumps, two circulating systems, and two motors to exploit their different characteristics for the above purposes.

SUMMARY OF THE INVENTION

It is an object of the present invention to solve the above-described problems in the conventional art.

According to the present invention, there is provided a pump incorporated in a textile package dyeing machine and comprising an axial flow impeller rotating in a concentric cylindrical housing to pump treatment dye liquor through the machine, the impeller having an axial nozzle at one end and a centrifugal nozzle at the other end whereby a flow and pressure performance characteristic typical for a centrifugal pump can be obtained when the impeller is rotated in one direction and a flow and pressure performance typical for an axial flow pump can be obtained when the impeller is rotated in the opposite direction.

The present invention makes the characteristics of both types of pumps able to be used to best advantage by mounting a conventional axial flow impeller inside the vessel with a suitably shaped discharge nozzle to permit dye liquor to exit in a partly radial direction on outside-in flow in order to retain a radial component of velocity in the discharged dye liquor, and by means of a divergent discharge passage thereby to use centrifugal force to augment the head potential of the conventional axial flow impeller, and for the same nozzle also to provide an easy path to guide dye liquor smoothly into the impeller eye by means of these partly toroid deflectors, so that conventional axial flow operation can be provided in the inside-out condition.

In addition to providing performance characteristics not otherwise available, the invention permits the axial flow pump to be used with a traditional bearing stand and horizontal driveshaft, using an in-line drive motor as is commonly used with centrifugal pumps.

The invention enables this centrifugal force to be used in one direction of rotation, instead of being cancelled out.

BRIEF DESCRIPTION OF THE DRAWINGS

These and other objects and advantages of the invention will become apparent and more readily appreciated from the following description of the preferred embodiment, taken in conjunction with the accompanying drawings of which.

DETAILED DESCRIPTION OF THE PREFERRED EMBODIMENT

Figure 1:
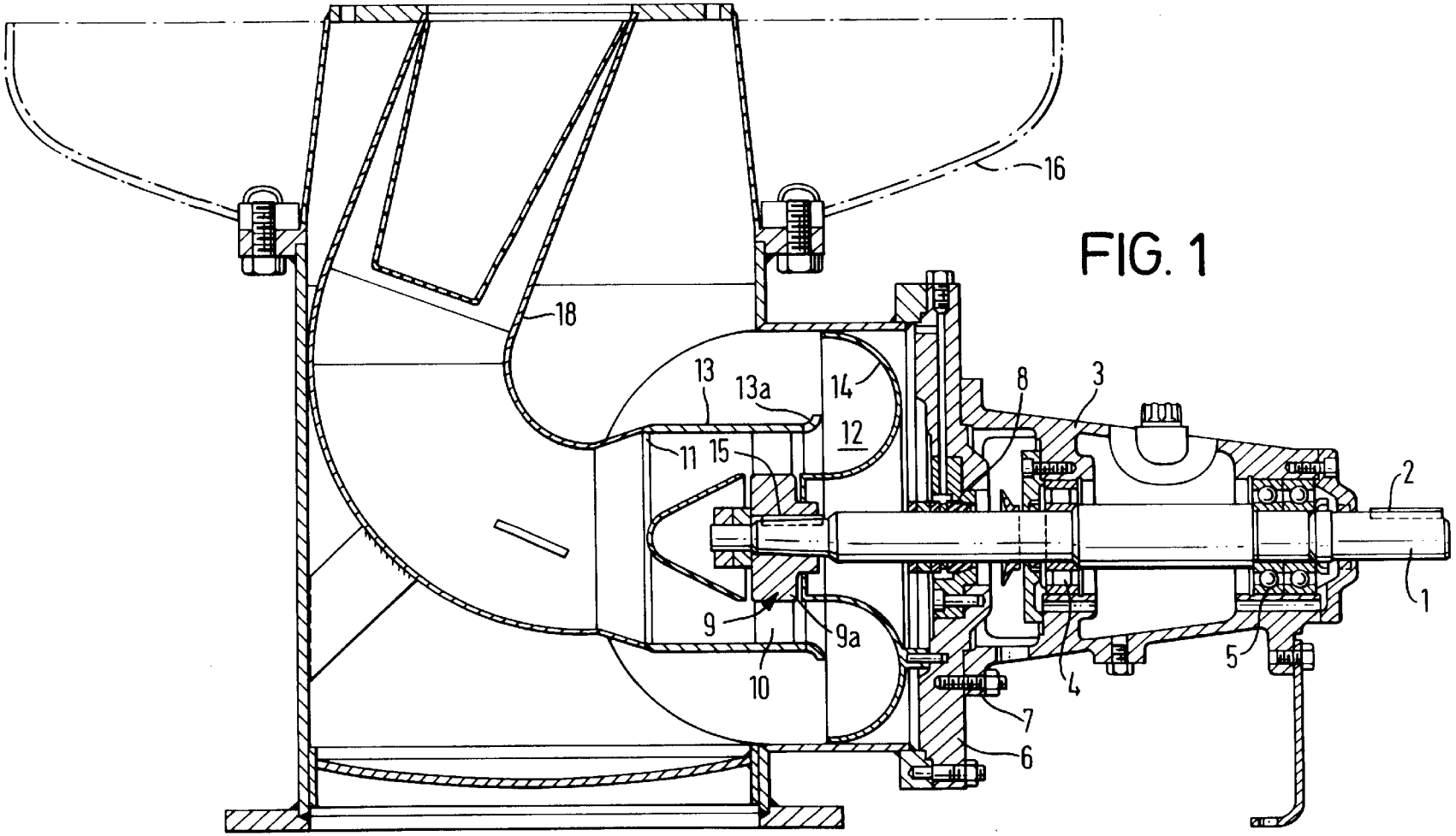
FIG. 1 is a sectional view through a pump incorporated in a textile package dyeing machine according to the present invention.

Reference will now be made in detail to the preferred embodiments of the present invention, examples of which are illustrated in the accompanying drawings FIGS. 1 to 2*b*, wherein like reference numerals refer to like elements throughout.

Referring to the drawings, a pump shaft 1 has a key 2, whereby it can be coupled to be driven by drive means such as an electric motor (not shown), and extends through a bearing stand 3 in which bearings 4 and 5 are provided. It further extends through a simple pump backplate 6 which is secured by bolts 7 to the bearing stand 3 and which mounts shaft seals 8.

An impeller 9 is keyed by a key 15 to the other end of the shaft 1 to that having the key 2 therein and has a cylindrical boss 9*a* in which are set blades 10 at an angle to its axis. The impeller 9 may be generally similar to the propellers used in Jet-ski or similar aquatic equipment. On the left side, (as viewed in FIG. 1) i.e. at one end of a concentrically mounted impeller housing 13, is an axial nozzle 11 and on the right side of the concentrically mounted impeller housing 13, i.e. at the other end of the impeller housing 13, is a quarter toroid pressing 13*a*. The pump backplate 6 is, as on conventional centrifugal pumps, equipped with a half torus pressing 14 to form, with the quarter toroid pressing 13*a*, a centrifugal nozzle 12. The pressings 13*a* and 14 are deflectors which provide a partial toroid or "trumpet" shape to the centrifugal nozzle 12.

Figure 2A:
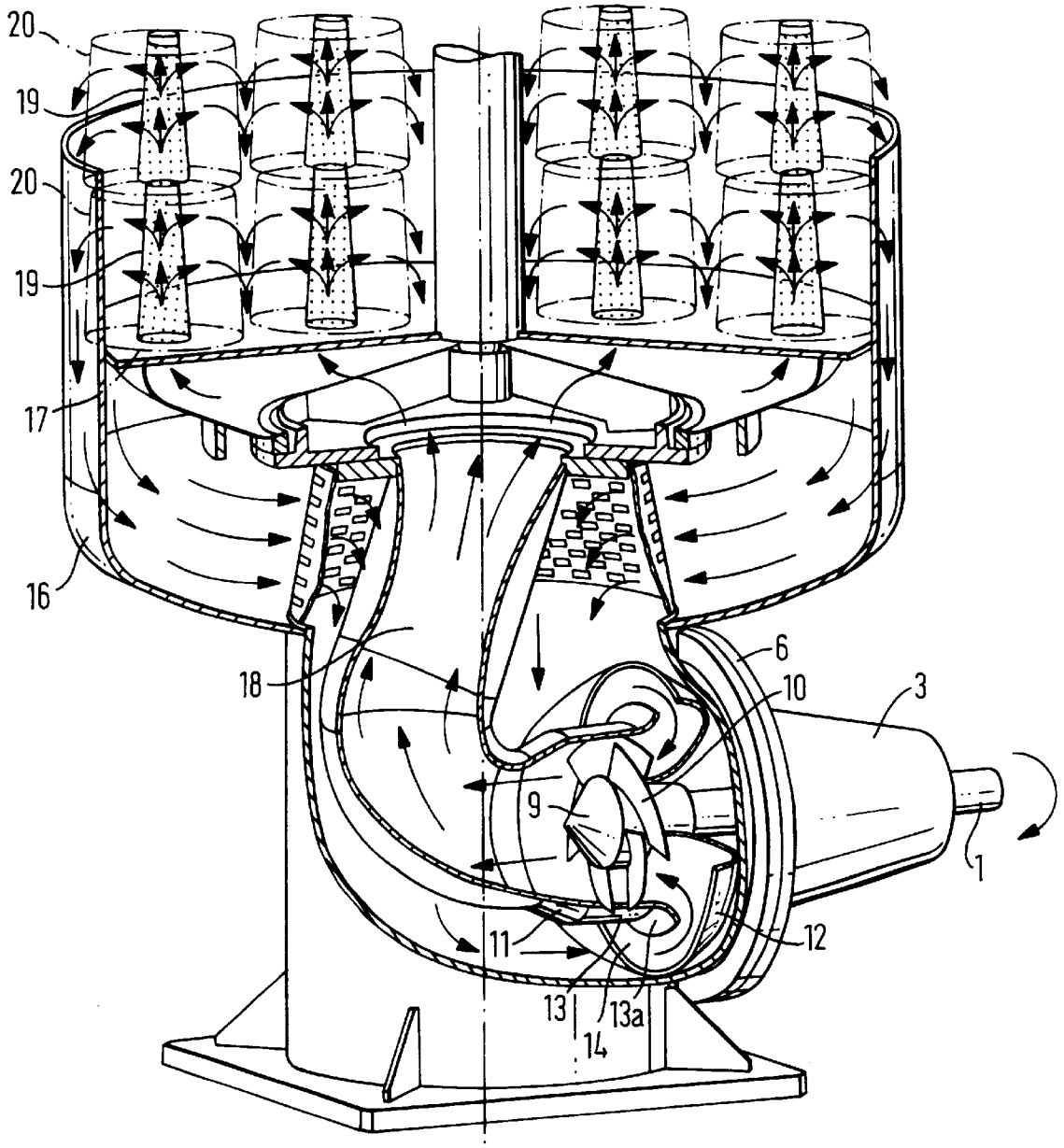
FIG. 2*a* and 2*b* show, respectively, use of the pump of FIG. 1 for inside-out treatment of textile yarns and for outside-in treatment of textile yarns, by treatment dye liquor.

When the rotation of the shaft 1 is as shown in FIG. 2*a*, liquid flows from right to left. The dye liquor in a vessel 16 underneath a package carrier 17 has unrestricted access to the impeller 9 through the centrifugal nozzle 12. The impeller 9 delivers the dye liquor into a conduit 18 joined by the axial nozzle 11 to the impeller housing 13 in the manner of a conventional axial flow pump. The conduit 18 leads the dye liquor to the perforated cores 19 of textile packages 20 so that dye liquor can pass through the packages in the inside-out flow to return to the vessel 16.

Figure 2B:
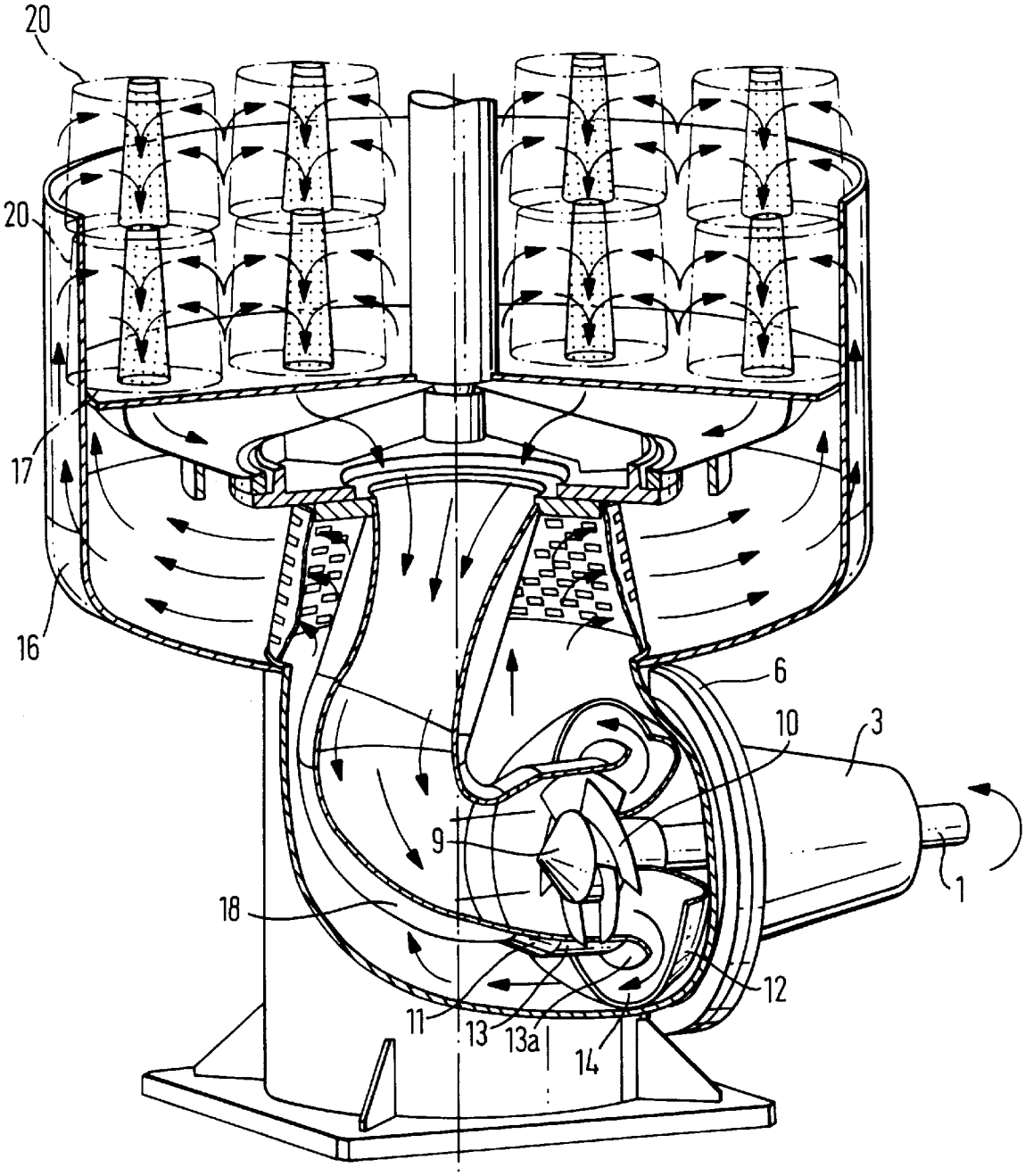

In an opposite direction of flow shown in FIG. 2*b*, the dye liquor leaving the impeller 9 is free to exit radially, as it would in a centrifugal pump, so that the pressure developed in the rotating dye liquor by centrifugal force and amplified by the divergent centrifugal exit nozzle 12 formed by the pressing 13*a* and the pressing 14, augments the limited pressure available to give a characteristic typical for a centrifugal pump. The dye liquor passing to the vessel 16 enters the packages 20 in the outside-in flow and passes into the perforated cores 19 before returning to the impeller 9 via the conduit 18, the axial nozzle 11 and the housing 13.

Although a preferred embodiment of the present invention has been described, it would be appreciated by those skilled in the art that changes may be made in these embodiments without departing from the principles and spirit of the invention, the scope of which is defined in the claims and their equivalents.

What is claimed is:

1. A pump incorporated in a textile package dyeing machine, comprising:

an axial flow impeller having an horizontal driveshaft relative to an axis of the textile package dyeing machine, the impeller rotating in an impeller housing in a first direction to pump treatment liquor axially through the impeller and through one end of the impeller housing to create an outside-in centrifugal treatment liquor flow that overcomes resistance against treatment liquor flow in the machine, and rotating in a second direction opposite to the first direction to pump the treatment liquor axially through the impeller and through another end of the impeller housing to create an inside-out axial treatment liquor flow.

2. A pump incorporated in a textile package dyeing machine, comprising:

an axial flow impeller having an horizontal driveshaft relative to an axis of the textile package dyeing machine, the impeller rotating in a concentric cylindrical impeller housing to pump treatment liquor through the machine;

a centrifugal nozzle disposed at one end of the impeller housing; and an axial nozzle disposed at another end of the impeller housing, wherein the impeller rotates in a first direction to pump the treatment liquor axially through the impeller and through the centrifugal nozzle to create an outside-in centrifugal flow and pressure of the treatment liquor in the machine, and rotates in a second direction opposite to the first direction to pump the treatment liquor axially through the impeller and through the axial nozzle to create an inside-out axial flow and pressure of the treatment liquor in the machine.

3. A pump as recited in claim 2, wherein the centrifugal nozzle has a partial toroid shape permitting an unrestricted exit of the treatment liquor in an increasing area radially outward from the impeller when the impeller pumps the treatment liquor in the outside-in flow, and providing a flow path of decreasing area to guide the treatment liquor towards the impeller in the inside-out flow.

4. A textile package dyeing machine, comprising:

an axial flow impeller having an horizontal driveshaft relative to said textile package dyeing machine, the impeller rotating in a concentric cylindrical impeller housing to pump dye liquor through the machine;

a centrifugal nozzle disposed at one end of the impeller housing;

an axial nozzle disposed at another end of the impeller housing;

a package carrier holding a load for treatment with the dye liquor;

a vessel holding the dye liquor and supporting the package carrier; and a conduit disposed within the vessel and connecting an inside of the package carrier to the axial nozzle, wherein the impeller rotates in a first direction and draws the dye liquor from the inside of the package carrier through the conduit and the axial nozzle and pumps the dye liquor through the centrifugal nozzle to create an outside-in centrifugal flow and pressure of the dye liquor in the machine, and wherein the impeller rotates in a second direction opposite the first direction and draws the dye liquor from the vessel through the centrifugal nozzle and pumps the dye liquor through the axial nozzle and the conduit into the package carrier to create an inside-out axial flow and pressure of the dye liquor in the machine.

5. A machine as recited in claim 4, further comprising a centrifugal pump bearing stand with a horizontal axis connected to the axial flow impeller.

* * * * *

UNITED STATES PATENT AND TRADEMARK OFFICE

CERTIFICATE OF CORRECTION

PATENT NO. : 5,946,950
DATED : September 7, 1999
INVENTOR(S) : TSUI et al.

It is certified that error appears in the above-identified patent and that said Letters Patent is hereby corrected as shown below:

On the title page of the patent in item [73], change the assignee, "Palmer Investments Limited" to be --Falmer Investments Limited--.

Signed and Sealed this

Thirteenth Day of June, 2000

*Attest:*

Q. TODD DICKINSON

*Attesting Officer*

*Director of Patents and Trademarks*